US007695229B2

(12) United States Patent
Cobene, II et al.

(10) Patent No.: US 7,695,229 B2
(45) Date of Patent: Apr. 13, 2010

(54) SERIAL METHOD OF BINDING A TEXT BODY TO A COVER

(75) Inventors: Robert L. Cobene, II, Santa Clara, CA (US); Eric Hoarau, San Francisco, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 905 days.

(21) Appl. No.: 10/697,037

(22) Filed: Oct. 31, 2003

(65) Prior Publication Data

US 2005/0095086 A1 May 5, 2005

(51) Int. Cl.
*B42C 9/00* (2006.01)

(52) U.S. Cl. ..... 412/8; 412/4; 412/6; 412/20; 412/37; 156/290

(58) Field of Classification Search ..... 412/1, 412/3, 4, 6, 8, 9, 17–20, 33, 36, 37; 156/290, 156/291, 227, 310, 908
See application file for complete search history.

(56) References Cited

U.S. PATENT DOCUMENTS 4,153,276 A * 5/1979 Ohlsson ..... 281/21.1
4,447,481 A * 5/1984 Holmberg et al. ..... 428/41.7
4,473,425 A * 9/1984 Baughman et al. ..... 156/356
4,498,828 A 2/1985 Ackerman et al.
4,525,116 A * 6/1985 Holmberg ..... 412/8
4,540,458 A * 9/1985 Baughman et al. ..... 156/312
4,673,324 A * 6/1987 Hanson et al. ..... 412/6
4,828,636 A * 5/1989 Rausing ..... 156/204
4,975,011 A * 12/1990 Holmberg ..... 412/6
5,045,417 A 9/1991 Okamoto et al.
5,437,476 A * 8/1995 Hutchinson ..... 281/15.1
5,569,011 A 10/1996 Yamaguchi et al.
5,702,219 A * 12/1997 Hattori ..... 412/6
5,927,547 A 7/1999 Papen et al.
6,024,525 A 2/2000 Yamanaka
6,040,026 A * 3/2000 Iwabuchi et al. ..... 428/40.1

(Continued)

FOREIGN PATENT DOCUMENTS

DE 3046533 A1 7/1982

(Continued)

OTHER PUBLICATIONS

U.S. Appl. No. 09/853,172 entitled "Dispensing Adhesive in a Bookbinding System", filed May 9, 2001.

(Continued)

*Primary Examiner*—Eric A Gates

(57) ABSTRACT

A method for adhesive binding and assembly of text bodies having plural sheets to a cover to form a bound document. Exemplary embodiments include applying an adhesive to a contacting surface of a plurality of sheets of the text body on an individual sheet-wide basis and adhering the plurality of sheets to the cover on an individual sheet-wide base by making line contact between the contacting surface and the cover and by curing the adhesive. Alternatively, the plurality of sheets can be positioned in a stand-off position from the cover and the adhesive can be applied into the gap. A system for binding a text body to a cover to form a bound document is also disclosed.

46 Claims, 5 Drawing Sheets

U.S. PATENT DOCUMENTS

| | | | | |
|---|---|---|---|---|
| 6,083,762 | A | 7/2000 | Papen et al. | |
| 6,153,047 | A * | 11/2000 | Gunasekera et al. | 156/463 |
| 6,203,759 | B1 | 3/2001 | Pelc et al. | |
| 6,213,703 | B1 * | 4/2001 | Garrido | 412/19 |
| 6,273,661 | B1 * | 8/2001 | Payne | 412/8 |
| 6,394,728 | B1 * | 5/2002 | Boss | 412/1 |
| 6,422,431 | B2 | 7/2002 | Pelc et al. | |
| 6,485,606 | B2 * | 11/2002 | Boss | 156/583.1 |
| 6,537,817 | B1 | 3/2003 | Papen | |
| 6,550,513 | B2 * | 4/2003 | Boss | 156/498 |
| 6,558,099 | B2 * | 5/2003 | Mendoza et al. | 412/1 |
| 6,601,840 | B2 * | 8/2003 | Boss et al. | 270/58.08 |
| 6,616,135 | B1 * | 9/2003 | Shida et al. | 270/58.08 |
| 6,712,924 | B2 * | 3/2004 | Silverbrook | 156/277 |
| 6,799,391 | B1 * | 10/2004 | Bergholtz et al. | 40/778 |
| 6,863,105 | B2 * | 3/2005 | Silverbrook | 156/384 |
| 6,926,791 | B2 * | 8/2005 | Boss | 156/277 |
| 6,948,897 | B2 * | 9/2005 | Lawton | 412/1 |
| 2002/0067977 | A1 * | 6/2002 | Cobene et al. | 412/1 |
| 2002/0115744 | A1 * | 8/2002 | Svenningsen et al. | 523/122 |
| 2002/0163175 | A1 | 11/2002 | Mendoza | |
| 2002/0168248 | A1 | 11/2002 | Ertel et al. | |
| 2003/0062132 | A1 | 4/2003 | Silverbrook | |
| 2003/0082029 | A1 * | 5/2003 | Silverbrook | 412/8 |
| 2003/0086773 | A1 | 5/2003 | Lawton | |
| 2003/0214092 | A1 * | 11/2003 | Horii et al. | 270/52.18 |
| 2004/0154740 | A1 * | 8/2004 | Silverbrook | 156/291 |
| 2005/0058526 | A1 * | 3/2005 | Silverbrook | 412/8 |

FOREIGN PATENT DOCUMENTS

| | | |
|---|---|---|
| WO | 02/062586 | 8/2002 |

OTHER PUBLICATIONS

U.S. Appl. No. 10/225,253 entitled "System and Method for Producing a Bound Media Body", filed Aug. 20, 2002.

U.S. Appl. No. 10/455,490 entitled "Systems and Methods of Edge Preparation for Binding a Text Body", filed Jun. 6, 2003.

ASTM D 1084-97, "Standard Test Methods for Viscosity of Adhesives" published by ASTM Committee on Standards, West Conshohocken, PA, May 1998.

IVEK Corp. DIGISPENSE 2000 [Online], IVEK Corp., 2003 [retrieved on Apr. 18, 2003]. Retrieved from the Internet: <URL:www.ivek.com/digi2000.shtml>.

3M Light Cure Ahdesive LC-1212 Technical Data, published by 3M Corporation, Minneapolis, Minnesota, Jan. 2002.

Basic Contact Angle Measurements on Paper, Application Note, published by First Ten Angstroms, Inc., Portsmouth, VA, Oct. 16, 1997.

Woodward, "Prediction of Adhesion and Wetting from Lewis Acid Base Measurements", presented at TPOs in Automotive (2000).

"Surface Energy Calculations", Application Note, First Ten Angstroms, Inc., Portsmouth, VA, Sep. 13, 2001.

* cited by examiner

SERIAL METHOD OF BINDING A TEXT BODY TO A COVER

BACKGROUND

Bookbinding systems can deliver bound documents, including books, manuals, publications, annual reports, newsletters, business plans and brochures. A bookbinding system collects a plurality of sheets (or pages) into a text body (or book block) and applies an adhesive to bind the text body to the cover to form a bound documents.

The choice of adhesive surface can affect how the bound document opens. For example, the cover may be attached to the bound text body by an adhesive on the side hinge areas or the spine of the text body, or both. The cover of a commercial soft cover book can be attached to the text spine. The covers of hardcover books and some soft cover "lay flat" books, on the other hand, are not attached to the text body spines (for example, the spines are floating). Also, where the adhesive is too generously applied such that adhesive is placed on the plane surface of the sheet (for example, the surface with text), adjacent sheets can adhere to one another causing the bound body to be rigid and difficult to open.

Text bodies can be assembled and covers can be attached by an adhesive applied to the spine area of the text body. Application of the adhesive and/or cover by a hinged system in the spine area can generate a localized buckle, accumulation or wrinkle as a force is applied over the adhesive. The localized buckle, accumulation or wrinkle can be unsightly as well as produce an inconsistent adhesive bond at the spine.

The number of pages in the text body to be bound can also affect the choice of adhesive surface and the method of application of the adhesive. For example, text bodies with low page counts (such as bodies with less than 20 to 50 sheets), have been assembled into booklets by various methods, including saddle-stitch methods such as stapling along the spine. Binding techniques for square spine documents have generally been applied to text bodies with higher page counts.

SUMMARY

An exemplary method of binding a text body to a cover with an adhesive to form a bound document comprises applying an adhesive to a contacting surface of a plurality of sheets of the text body on an individual sheet-wise basis and adhering the plurality of sheets to the cover on an individual sheet-wise basis by making line contact between the contacting surface and the cover and by curing the adhesive.

An exemplary method of binding a text body to a cover with an adhesive to form a bound document comprises applying a first part of a two-part adhesive system to the contacting surface of a sheet of the text body on an individual sheet-wise basis, applying a second part of the two-part adhesive system to the cover, and adhering the sheet to the cover on an individual sheet-wise basis by making line contact between the contacting surface and the cover and by curing the two-part adhesive system.

An exemplary method of binding a text body to a cover with an adhesive to form a bound document comprises positioning each of a plurality of sheets of the text body in a stand-off position from the cover on an individual sheet-wise basis, the stand-off position forming a gap between the contacting surface and the cover, applying an adhesive into the gap on an individual sheet-wise basis, the adhesive contacting both the contacting surface and the cover, and curing the adhesive to adhere the sheet to the cover.

BRIEF DESCRIPTION OF THE DRAWING FIGURES

The following detailed description of preferred embodiments can be read in connection with the accompanying drawings in which like numerals designate like elements and in which.

Figure 4:
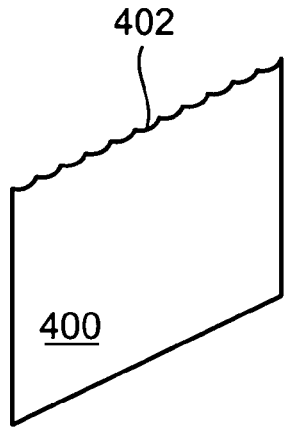

FIG. 4 schematically illustrates an exemplary non-linear contacting surface formed on an individual sheet by disclosed edge preparation methods.

Figure 5:
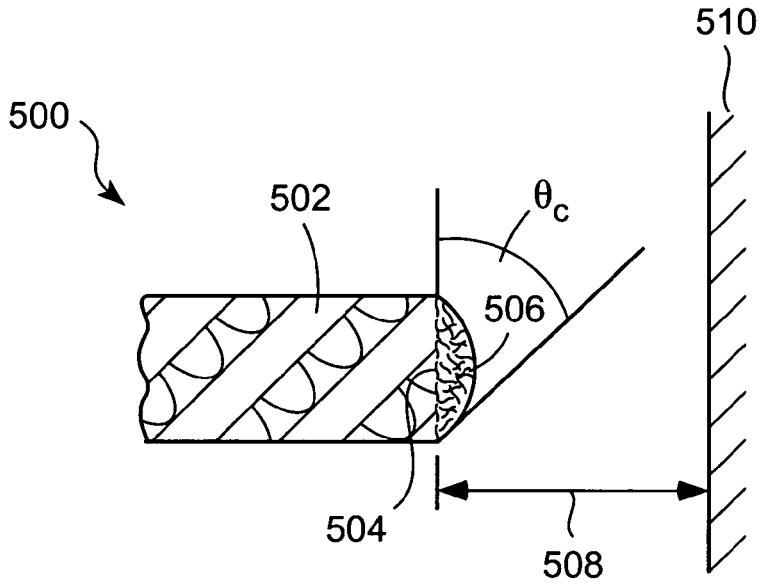

FIG. 5 illustrates an exemplary embodiment of a contacting surface.

Figure 6:
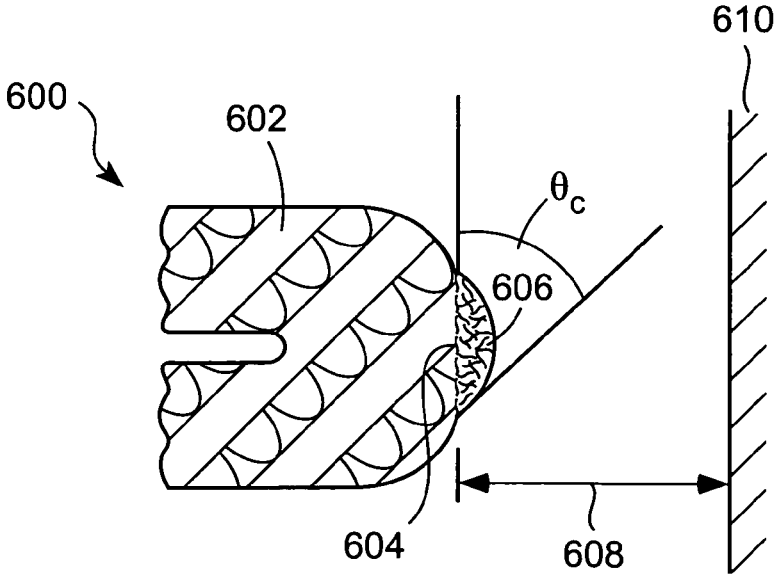

FIG. 6 illustrates another exemplary embodiment of a contacting surface.

Figure 7:
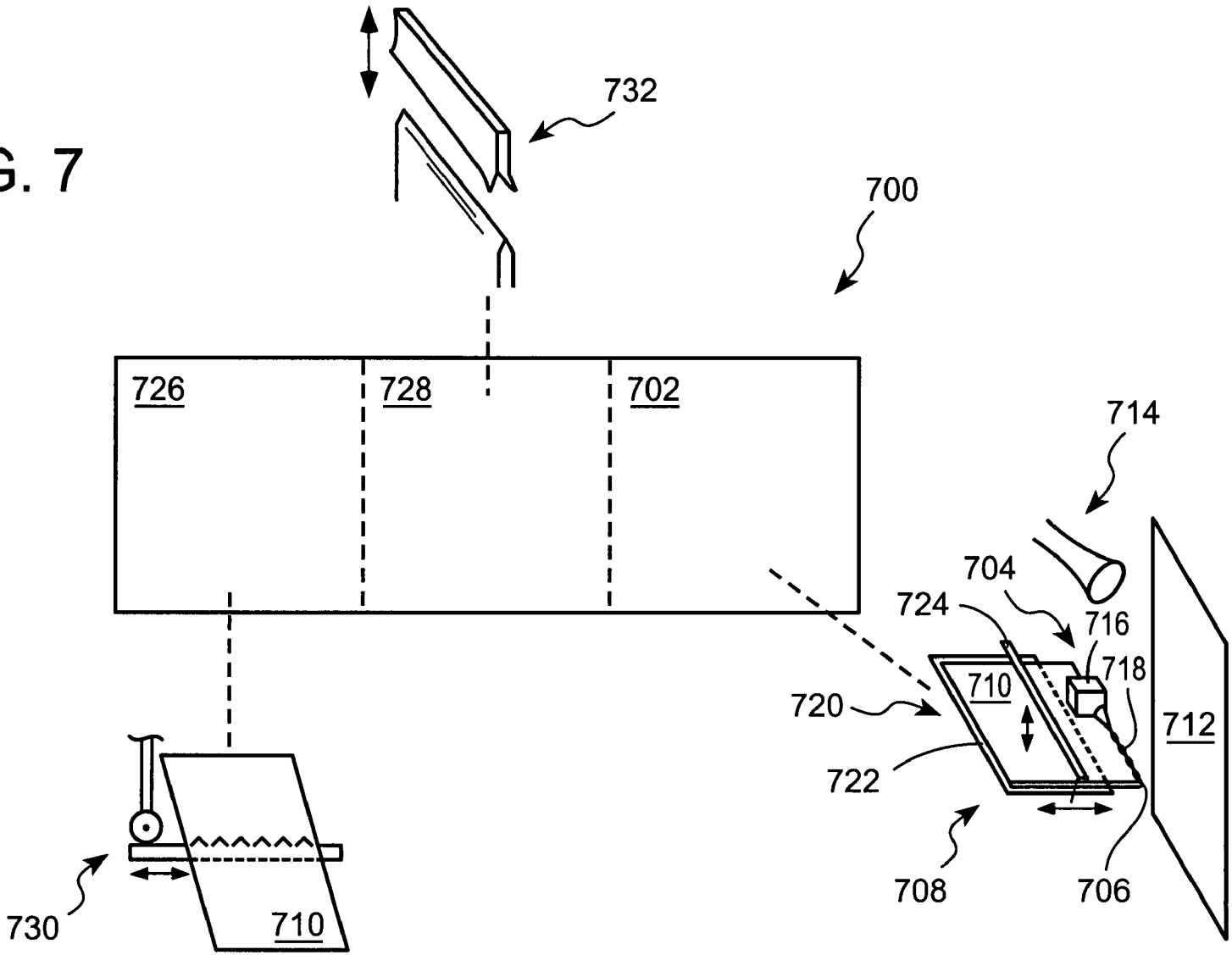

FIG. 7 illustrates an exemplary system for binding a text body to a cover with an adhesive to form a bound document.

DETAILED DESCRIPTION

Figure 1:
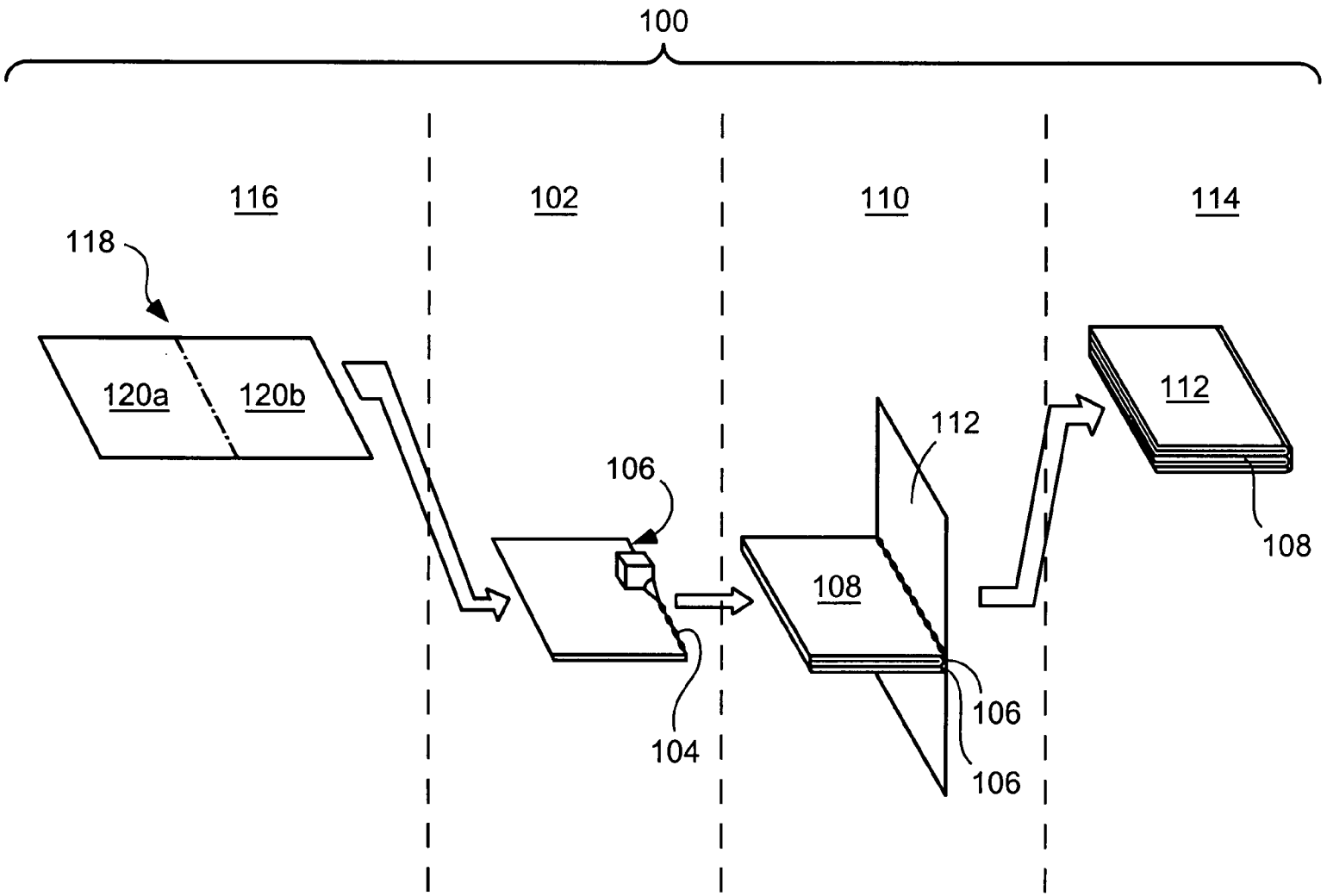
FIG. 1 illustrates an exemplary method of binding a text body to a cover with an adhesive to form a bound document.

An exemplary method of binding a text body to a cover with an adhesive to form a bound document is illustrated in FIG. 1. The FIG. 1 method 100 comprises applying 102 an adhesive 104 to a contacting surface 106 of a plurality of sheets of the text body 108 on an individual sheet-wise basis and adhering 110 the plurality of sheets to the cover 112 on an individual sheet-wise basis by making line contact between the contacting surface 106 and the cover 112 and by curing the adhesive.

In a subsequent optional operation, the exemplary method 100 includes forming 114 the cover 112 around the text body 108. The cover can be prepared to a selected spine width, such as a spine width corresponding to a dimension of the text body, either prior to or after the line contact is made. The cover can be prepared, for example, by scoring the cover prior to adhering the plurality of sheets to the cover or after adhering the plurality of sheets to the cover but prior to forming the cover around the text body. Other examples of methods for preparing covers to be affixed with adhesive to text bodies are disclosed in commonly-owned U.S. patent application Ser. No. 09/853,172 entitled "DISPENSING ADHESIVE IN A BOOKBINDING SYSTEM", in which perforation and adhesive techniques are disclosed.

In the exemplary method 100, the contacting surface can first make line contact with and adhere to an intermediary piece, such as a portion of a floating spine system. Subsequently, the cover can be formed around the intermediary piece with the adhered text body to form the bound document.

Figure 2:
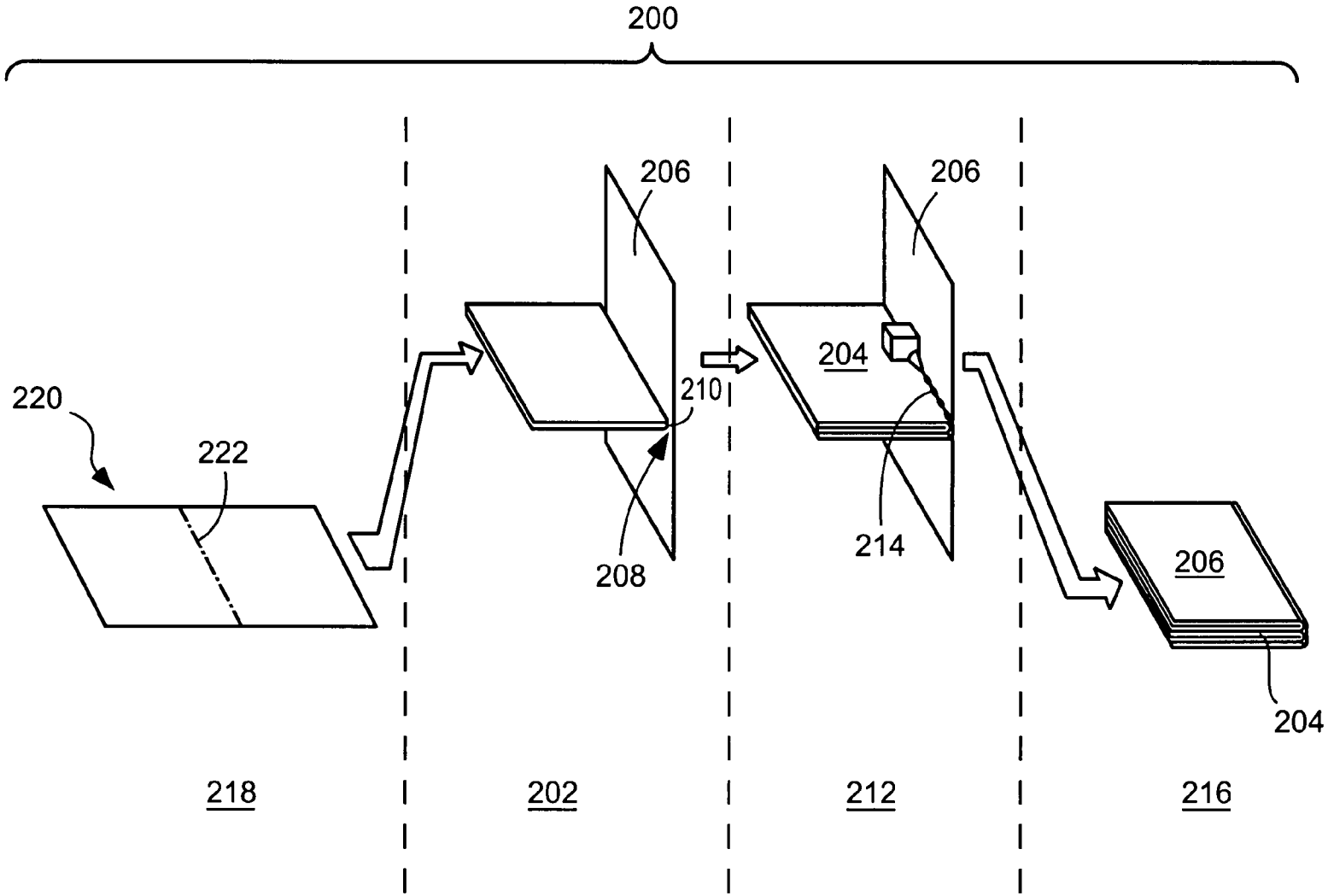
FIG. 2 illustrates another exemplary method of binding a text body to a cover with an adhesive to form a bound document.

Another exemplary method of binding a text body to a cover with an adhesive to form a bound document is illustrated in FIG. 2. The FIG. 2 method 200 comprises positioning 202 each of a plurality of sheets of the text body 204 in a stand-off position from the cover 206 on an individual sheet-wise basis. The stand-off position forms a gap 208 between the contacting surface 210 and the cover 206. An exemplary gap is on the order of magnitude of a thickness of a sheet of the text body to be bound to the cover, e.g., for uncoated 20 pound bond sheet, the gap is about 0.01 cm to 0.06 cm. The exemplary method 200 then applies 212 an adhesive 214 into the gap 208 on an individual sheet-wise basis, the adhesive 214 contacting both the contacting surface 210 and the cover 206, and curing the adhesive 214 to adhere the sheet to the cover 206.

In a subsequent optional operation, the exemplary method 200 includes forming 216 the cover 206 around the text body 204. The cover can be prepared to a selected spine width, such as a spine width corresponding to a dimension of the text body, either prior to or after the line contact is made. The cover can be prepared, for example, by scoring the cover prior to adhering the plurality of sheets to the cover or after adhering the plurality of sheets to the cover but prior to forming the cover around the text body, or by other cover preparation methods. Also, in the exemplary method 200, the contacting surface can first make line contact with and adhere to an intermediary piece, such as a portion of a floating spine system. Subsequently, the cover can be formed around the intermediary piece with the adhered text body to form the bound document.

Figure 3:
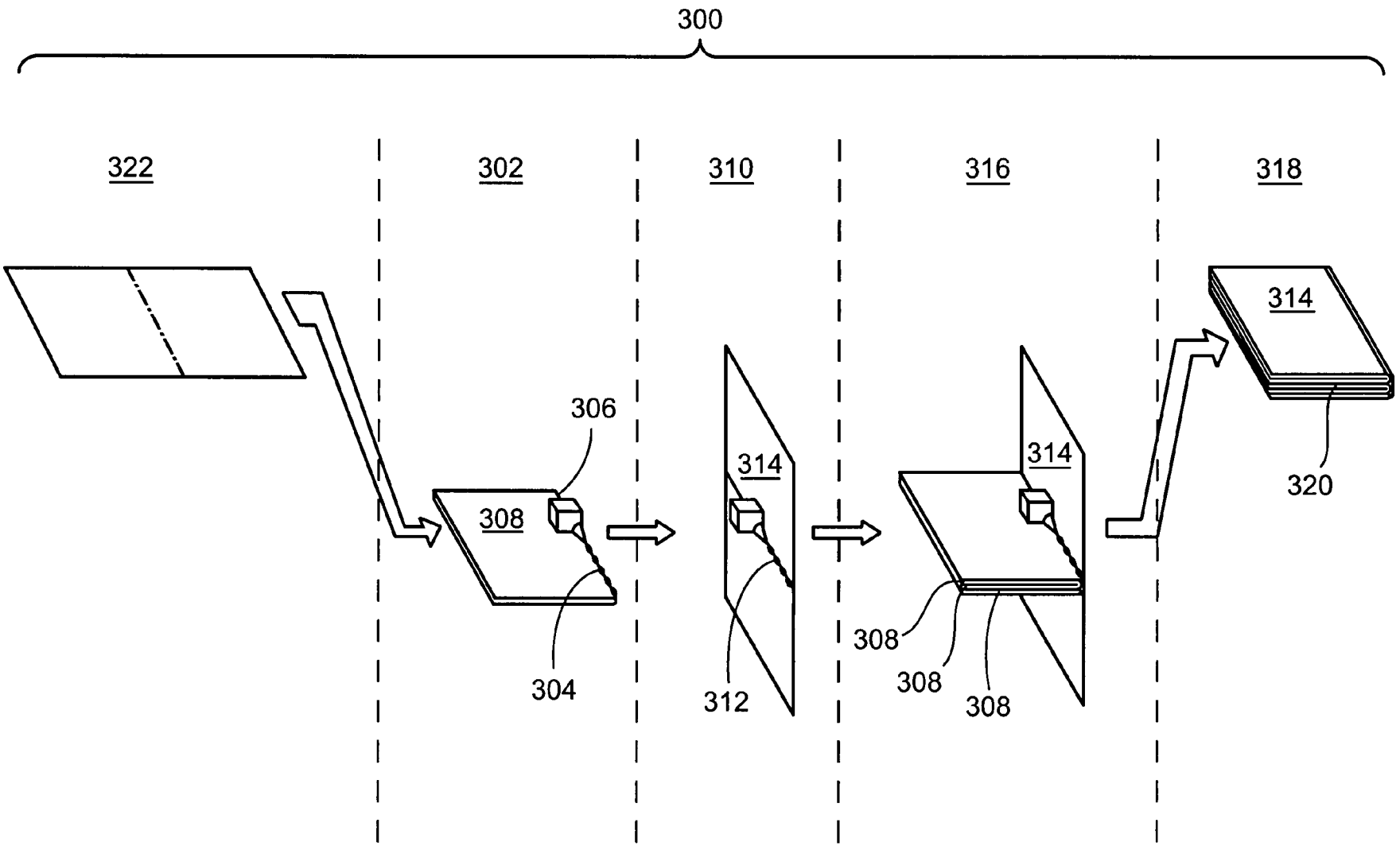
FIG. 3 illustrates another exemplary method of binding a text body to a cover with an adhesive to form a bound document.

Another exemplary method of binding a text body to a cover with an adhesive to form a bound document is illustrated in FIG. 3. The FIG. 3 method 300 comprises applying 302 a first part 304 of a two-part adhesive system to the contacting surface 306 of a sheet 308 of the text body on an individual sheet-wise basis, applying 310 a second part 312 of the two-part adhesive system to the cover 314, and adhering 316 the sheet 308 to the cover 314 on an individual sheet-wise basis by making line contact between the contacting surface 306 and the cover 314 and by curing the adhesive. For example, a first part of a two-part adhesive system can be in liquid form and applied to the contacting surface, e.g. the binding edge, of the sheet of the text body and the second part of the two-part adhesive system can be in liquid form and applied to the cover. Alternatively, either the first part of the two-part adhesive system and/or the second part of the two-part adhesive system can be in gel form or in sheet form.

In a subsequent optional operation, the exemplary method 300 includes forming 318 the cover 314 around the text body 320. The cover can be prepared to a selected spine width, such as a spine width corresponding to a dimension of the text body, either prior to or after the line contact is made. The cover can be prepared, for example, by scoring the cover prior to adhering the plurality of sheets to the cover or after adhering the plurality of sheets to the cover but prior to forming the cover around the text body, or by other cover preparation methods. Also, in the exemplary method 300, the contacting surface can first make line contact with and adhere to an intermediary piece, such as a portion of a floating spine system. Subsequently, the cover can be formed around the intermediary piece with the adhered text body to form the bound document.

When the adhesive is applied to the contacting surface (as in the FIG. 1 exemplary method) or is applied into the gap (as in the FIG. 2 exemplary method), or when the first part of the two-part adhesive system is applied to the contacting surface (as in the FIG. 3 exemplary embodiment), the applied adhesive forms a non-zero contact angle with the contacting surface. As generally understood, the contact angle originates with the balance of forces at the line of contact between a liquid, solid and gas, for example, the applied adhesive and the contacting surface. For a contact angle between 0° and 90°, the liquid is said to wet or spread over the surface. For a contact angle from 90 to 180°, the surface is said to be non-wetted. At a contact angle of zero degrees, the liquid flows along or into the solid; for example, the applied adhesive flows into the contacting surface. In an exemplary embodiment, the contact angle between the adhesive and the contacting surface is non-zero, such as a contact angle of, for example, greater than 45° such that the adhesive both flows along and into the contacting surface to provide adequate adhesion to the contact surface and also forms a bead on the contact surface to provide a volume of the adhesive to adhere to a surface to which the contact surface is contacted.

The adhesive can be any suitable adhesive having a viscosity that produces a non-zero contact angle in conjunction with the surface energy of the contacting surface, e.g. the edge of the sheet of the text body. Suitable adhesives for twenty pound bond paper have a viscosity of greater than 1000 centipoises. For example, a suitable adhesive for twenty pound bond paper has a viscosity of from 10,000 to 15,000 centipoises, such as LC-1212 light curable adhesive available from 3M® Corporation of Minneapolis, Minn., which has a viscosity of approximately 12,700 centipoises. The viscosity is determined at 72° F. using a Brookfield DV-1+ with a spindle number LV-3 operated at 6 rpm in conformance with ASTM standard D 1084-97.

Examples of suitable adhesives include a hot melt adhesive, a light curable adhesive, a two-part adhesive system, or a moisture curable adhesive. In an exemplary embodiment, the adhesive is a light curable adhesive curable at a wavelength of 400 to 500 nanometers (nm) at approximately 750 milliwatts per centimeter squared ($mW/cm^2$). In another exemplary embodiment, the adhesive is a light curable adhesive curable at a wavelength of 250 to 380 nm at approximately 20 watts per centimeter squared. A suitable light curable adhesive includes LC-1212 light curable adhesive available from 3M® Corporation of Minneapolis, Minn., which cures at a wavelength of 400 to 500 nm. When dispensed on a contacting surface of a twenty pound bond paper, this adhesive forms a non-zero contact angle. Other suitable light curable adhesives include acrylate-based adhesives curable in the visible, ultraviolet (UV) or infrared (IR) spectrum.

The method optionally includes preparing each of the plurality of sheets of the text body along the contacting surface prior to applying the adhesive. In an exemplary embodiment, preparing includes one of roughening, cutting, tearing, trimming, bending, folding and perforating. Preparing exposes a plurality of base fibers of the sheets. Additional methods of edge preparation of paper to improve binding adhesion are disclosed in U.S. patent application Ser. No. 10/225,253 entitled "System and Method for Producing A Bound Media Body", filed Aug. 20, 2002, and U.S. patent application Ser. No. 10/455,490 entitled "Systems and Methods of Edge Preparation for Binding a Text Body", filed Jun. 6, 2003. Disclosed edge preparation methods include notch binding, in which notches are made on the contacting surface, e.g., edge or folded edge, by removing small sections to allow penetration of adhesive into the individual sheets, and burst binding, in which large cuts made in the contacting surface of the sheet allow penetration of adhesive material. Additional disclosed edge preparation methods include making slits on the contacting surface with, for example, a toothed wheel, and milling the contacting surface with a grinder to produce rough edges. Fibers in the sheet exposed in these methods strengthen adhesion between the adhesive material and the sheet. Also, the area of the contacting surface exposed to the adhesive is increased to thereby increase the binding strength. FIG. 4 schematically illustrates the non-linear contacting surface 402 formed on an individual sheet 400 by the disclosed edge preparation methods.

The FIG. 1 exemplary method 116 can include an optional preparing step 118. In the illustrated example, sheet portions 120*a* and 120*b* can be folded to prepare a sheet 118 (for example, to prepare a folded edge). The sheet 118 can optionally be perforated or scored along a line prior to folding. The FIG. 2 exemplary method 200 can include optionally preparing 218 the contacting surface. In the illustrated example, a sheet 220 is folded to prepare the contacting surface 210 (for example, to prepare the folded edge). The sheet 220, can optionally be perforated or scored along line 222 prior to folding. In FIG. 3, the exemplary method 300 can include optionally preparing 322 the contacting surface prior to applying the adhesive by any suitable method.

Preparing the contacting surface can increase a surface area of the contacting surface. For example, for coated or surface modified papers, such as some sheets for printing of photomedia, paper fibers at the surface, end or edge of a sheet can have a coating and a higher surface energy than uncoated papers. In contrast, uncoated interior fibers of coated or surface modified papers can have a lower surface energy, e.g., generally on the order of conventional 20 lb. bond uncoated paper. Preparation of the contacting surface for coated or surface modified papers can expose base or interior fibers, and/or increase the surface area on the contacting surface and thereby reduce the surface energy of the contacting surface. When the surface energy of the contacting surface is lowered, the contact angle formed with the applied adhesive is lowered.

The surface energy (or interfacial tension between a liquid and a surface) can be determined from any suitable method. One suitable method is based on Young's equation:

$$\gamma_{SL}=\gamma_S-\gamma_L\cos(\theta)$$

where:

$\gamma_{SL}$=interfacial tension between the liquid and the surface $\gamma_S$=interfacial tension between the surface and the vapor $\gamma_L$=interfacial tension between the liquid and the vapor $\cos(\theta)$=cosine of the angle between the liquid and the surface For measuring interfacial tension, one measures $\gamma_S$ by using reference liquids (water, diiodomethane, glycerol . . . ) on the surface to be analyzed. Using the reference liquids, a contact angle on the surface is measured and these values of contact angles allow computation of the specific equations of state. To measure $\gamma_L$, a pendant drop method can be used to measure the surface tension of the liquid. The contact angle between the liquid (e.g., the adhesive) on the surface and the surface is measured. From these values, one can predict the wettability, calculate the spreading coefficient and the surface energy as well as other surface chemistry parameters. A method for determining the contact angle on paper is disclosed in "*Basic Contact Angle Measurements on Paper*", Application Note, First Ten Angstroms, Inc., Portsmouth Va., Oct. 16, 1997. In this document, the measurement of contact angles and absorbency with image acquisition technology is presented and discussed.

Other suitable methods to determine surface chemistry parameters, such as surface energy, include predictions based on Lewis Acid Base measurements, the method of Owens and Wendt (geometric mean method), Zisman critical wetting tension models, the Girifalco, Good, Fowkes, Young combining rule, and Wu harmonic mean. Methods employing Lewis Acid Base measurements are disclosed, for example, in Woodward, "*Prediction of Adhesion and Wetting from Lewis Acid Base Measurements*", presented at TPOs in Automotive (2000). In this document, Lewis Acid Base measurements are described, including laboratory techniques for using Lewis Acid Base measurements to determine surface energies from measured contact angles of different reference liquids. In the Owens and Wendt method, the surface energy (in dynes/cm) is determined from the contact angles (taken at one second) of a polar solvent and a nonpolar solvent, such as water and methyl iodide, respectively.

It is to be understood that each of the above identified methods for determining surface energy may be employed within the disclosed method. Further, those of skill in the art would appreciate that the actual measured surface energy will vary based on the testing method selected. and that values of surface energy given herein are approximations, which may vary by up to ±25%, based on the method selected. A discussion of the relative merits of each of the above-identified methods is presented in "*Surface Energy Calculations*", Application Note, First Ten Angstroms, Inc., Portsmouth Va., Sep. 13, 2001.

The surface energy of example papers are provided in Table 1, which summarizes the surface energy calculations following the method of Owens and Wendt and using water and methyl iodide.

TABLE 1

| | | | | Surface Energy Calculations | | | | | |
|---|---|---|---|---|---|---|---|---|---|
| Sample Paper | Side | Contact Angle$_{H2O}$ | Contact Angle$_{Methyl\ Iodide}$ | Cosine of Contact Angle$_{H2O}$ | Cosine of Contact Angle$_{Methyl\ Iodide}$ | Surface Energy of Nonpolar Component (dynes/cm) | Surface Energy of Polar Component (dynes/cm) | Total Surface Energy (dynes/cm) | Average Total Surface Energy (dynes/cm) |
| HP ® LaserJet ® Paper | A | 115.1° | 42.6° | −0.42 | 0.74 | 41.99 | 1.71 | 43.70 | |
| | B | 108.9° | 41.1° | −0.32 | 0.75 | 41.70 | 0.61 | 42.31 | 43.01 |
| HP ® Bright White ®, Generation III | A | 109.8° | 22.5° | −0.34 | 0.92 | 51.25 | 1.74 | 52.99 | |
| | B | 112.7° | 23.4° | −0.39 | 0.92 | 51.52 | 2.47 | 53.99 | 53.49 |

In an exemplary method, the difference between the surface energy of the adhesive and the surface energy of the contacting surface is from about 13-25 dynes per cm. If the difference in surface energy between the adhesive and the contacting surface is too low, e.g. less than to 5 to 10 dynes per cm, the adhesive can spread and penetrate or wick into the contacting surface to which it is applied, for example, the sheet edge. Thus, a first portion of the adhesive is in the interior of the sheet and a second portion of the adhesive remains at the contacting surface. The second portion may not be sufficient to adequately bond the sheet to adjacent sheets or to the cover. If the difference in surface energy between the adhesive and the contacting surface is too high, e.g. greater than 40 to 50 dynes per cm, the applied adhesive can dome, forming a drop of adhesive that may not sufficiently penetrate into the contacting surface of the sheet to bond the sheet to adjacent sheets or to a cover. Thus, a suitable difference in surface energy between the adhesive and the contacting surface can be used to balance the spreading of the adhesive and the doming of the adhesive. In an exemplary method for 20 pound uncoated bond paper, the plurality of sheets can include a cellulosic sheet having a surface energy of 30 to 37 dynes per cm and the adhesive can be a light curable adhesive such as LLC-1211, available from 3M® Corporation of Minneapolis, Minn., having a surface energy of 50-55 dynes per cm.

The contacting surface can be any suitable edge surface of the sheet. FIG. 5 illustrates an exemplary embodiment of a contacting surface 500 in magnified schematic view. In FIG. 5, the sheet is an unfolded sheet 502 and the contacting surface is an edge 504 of the unfolded sheet 502. As shown, the adhesive 506 forms a contact angle, $\theta_c$, with the contacting surface (such as edge 504). In the FIG. 5 embodiment, the edge 504 of the unfolded sheet 502 is in a stand-off position with a gap 508 between the edge 504 and a cover 510.

FIG. 6 illustrates another exemplary embodiment of a contacting surface 600. In the FIG. 6 magnified schematic view of an exemplary embodiment of a contacting surface 600, the sheet is a folded sheet 602 and the contacting surface is a folded edge 604 of the folded sheet 602. For example, the contacting surface can be prepared by folding. As shown, the adhesive 606 forms a contact angle, $\theta_c$, with a contacting surface, such as the folded edge 604. In the FIG. 6 embodiment, the folded edge 604 of the folded sheet 602 is in a stand-off position with a gap 608 between the folded edge 604 and a cover 610.

In the exemplary method, the contacting surface can be optionally constrained while applying the adhesive. For an unfolded sheet, the exemplary method optionally comprises constraining the sheet to maintain the edge straight. For a folded sheet, the exemplary method optionally comprises constraining the folded sheet to maintain the folded edge straight.

The contacting surface can be constrained by any suitable constraining device. For example, plates, clamps, or other suitable constraining devices can be placed in contact with the sheet such that the contacting surface is exposed and accessible to the dispenser. The constraining device can be positioned along the total length of the contacting surface or intermittently along the contacting surface. The position and/or number of constraining devices and the length of sheet protruding from the constraining device can be a function of the paper properties, such as the paper weight, structural character or so forth.

The adhesive can be applied in any suitable manner. In an exemplary embodiment, applying the adhesive includes dispensing the adhesive from a dispenser. The dispenser can include a time-pressure system, a piston-valve system, an auger-valve system, or a jetting system. An exemplary piston-valve system includes a DIGISPENSE 2000 system available from Ivek Corporation of North Springfield, Va. In another exemplary embodiment, the dispenser can include an automated liquid handling system having a positive displacement pump, a pressure sensor, and a microdispensor and uses the change in a known volume of a compressible fluid above the dispensing volume to monitor the dispensing of sub-nanoliter size individual droplets. Further details of automated liquid handling systems including types of pumps, volumes dispensed and the control systems for dispensing desired volumes of liquid are disclosed in U.S. Pat. Nos. 6,537,817; 6,422,431; 6,203,759; 6.083,762; and 5,927,547.

In another exemplary embodiment, the dispenser can include a micro-electro-mechanical system (MEMS). MEMS include mechanical elements, sensors, actuators, and electronics integrated on a common silicon substrate through microfabrication technology. While the electronics of MEMS are fabricated using integrated circuit (IC) process sequences (e.g., CMOS, Bipolar, or BICMOS processes), the micromechanical components are fabricated using compatible micromachining processes that selectively etch away parts of the silicon wafer or add new structural layers to form the mechanical and electromechanical devices. An example of a MEMS includes a thermal ink jet device. A suitable thermal ink jet device adaptable to dispense adhesive has an adhesive in the internal reservoir and is disclosed in U.S. Pat. No. 6,273,661.

The dispenser can apply adhesive in a suitable volume on the contacting surface. For example, adhesive can be dispensed from a dispenser as a continuous bead on the contacting surface. A volume of the continuous bead can be less than or equal to three microliters. In another example, adhesive can be dispensed as a plurality of individual sub-beads on the contacting surface. A volume of each individual sub-bead is less than or equal to ten nanoliters. Jetting systems and MEMS can be combined in a dispenser for adhesives with viscosities of 10,000 to 15,000 centipoises having application rates of up to about one bead per 25 milliseconds.

FIG. 7 illustrates an exemplary system 700 for binding a text body to a cover with an adhesive to form a bound document. In an assembly area 702, the system 700 comprises means for applying 704 an adhesive to a contacting surface 706 of a plurality of sheets of the text body on an individual sheet-by-sheet basis and means for relative motion 708 between the individual sheets 710 of the text body and the cover 712 to make line contact between the contacting surface 706 and the cover 712. The assembly area 702 optionally contains means for curing the adhesive 714 to adhere the individual sheet 710 of the text body to the cover 712. An exemplary means for curing the adhesive 714 is shown in FIG. 7 as a radiation source, a heat source or a heat sink.

Means for applying 704 an adhesive can be any suitable means, such as a dispenser containing a time-pressure system, a piston-valve system, an auger-valve system, or a jetting system or a dispenser containing a Micro-Electro-Mechanical System. Means for applying 704 dispenses a plurality of individual sub-beads of the adhesive on the contacting surface and a volume of each individual sub-bead is less than or equal to ten nanoliters. An exemplary means for applying 704 an adhesive is shown in FIG. 7 as dispenser 716 dispensing sub-beads 718 of adhesive on contacting surface 706.

Means for relative motion 708 can be any suitable means, such as a clamping device 720 holding the individual sheets 710 in contacting alignment with the cover 712. The clamping device 720 has a stage 722 supporting the sheet 710 and a clamping bar 724 which translates to contact the sheet 710. The clamping device 720 is mounted for translation on a support, which can include a rail and means for relative motion, such as a source of motive force for translating the clamping device 720.

The system 700 also optionally includes an edge preparation area 726, in which contacting surfaces 706 of individual sheets 710 are prepared, and optionally includes a sheet folding area 728. An exemplary edge preparation device 730, e.g., a translating toothed bar, and an exemplary sheet folder 732, e.g., a fold blade and housing, are shown in FIG. 7.

In an exemplary embodiment, applying the adhesive can place a plurality of nanoliter volume sub-beads on the contacting surface at an application rate of no slower than one bead per 75 microseconds. For example, the adhesive can be applied at a rate of no slower than one bead per 50 microseconds or at a rate of no slower than one bead per 25 microseconds. Alternatively, applying the adhesive can place a continuous bead of adhesive on the contacting surface, place an array or matrix of dots or beads on the contacting surface, or place an arrangement of stripes on the contacting surface. Further, the contacting surface can be wholly or partially covered by the adhesive.

In an exemplary embodiment, the plurality of sheets includes a sheet of 20 pound uncoated bond paper, the adhesive is a light curable adhesive having a viscosity of about 10,000 to 12,000 centipoises, applying the adhesive dispenses a plurality of nanoliter volume beads on the contacting surface, and the adhesive cures in less than or equal to 20 seconds to bond the contacting surface to the cover. Each nanoliter volume sub-bead has a volume of less than or equal to 10 nanoliters and produces a bond spot having a diameter of less than or equal to 0.5 millimeters.

In another exemplary embodiment, the plurality of sheets includes a cellulosic sheet having a surface energy of 30 to 37 dynes per cm, the adhesive is a light curable adhesive having a surface energy of 50 to 55 dynes per cm, applying the adhesive dispenses a plurality of nanoliter volume sub-beads on the contacting surface, and the adhesive cures in less than or equal to 20 seconds to bond the contacting surface to the cover. Each nanoliter volume sub-bead has a volume of less than or equal to 10 nanoliters and produces a bond spot having a diameter of less than or equal to 0.5 millimeters.

Although preferred embodiments have been described, it will be appreciated by those skilled in the art that additions, deletions, modifications, and substitutions not specifically described may be made without department from the spirit and scope of the invention as defined in the appended claims.

What is claimed is:

1. A method of binding a text body to a cover with an adhesive to form a bound document, the method comprising:

applying an adhesive to an edge contacting surface of each of a plurality of sheets of the text body on an individual sheet-wise basis, wherein the adhesive is applied to the edge contacting surface of each of the plurality of sheets without applying any adhesive to side surfaces of the corresponding sheet; and adhering the plurality of sheets to the cover on an individual sheet-wise basis by making line contact between the edge contacting surface of each sheet and the cover and by curing the adhesive, wherein the applied adhesive forms a non-zero contact angle with the edge contacting surface.

2. The method of claim 1, wherein a viscosity of the adhesive is greater than 1000 centipoises and less than 15,000 centipoises.

3. The method of claim 1, comprising preparing each of the plurality of sheets of the text body along the edge contacting surface prior to applying the adhesive.

4. The method of claim 3, wherein preparing increases a surface area of the edge contacting surface, exposes a plurality of base fibers of the sheets, or increases the surface area and exposes the plurality of base fibers.

5. The method of claim 1, wherein applying the adhesive includes dispensing the adhesive from a dispenser, the dispenser including a time-pressure system, a piston-valve system, an auger-valve system, or a jetting system.

6. The method of claim 1, wherein applying the adhesive includes dispensing the adhesive from a dispenser including a Micro-Electro-Mechanical System, the adhesive is dispensed as a continuous bead on the edge contacting surface, and a volume of the continuous bead is less than or equal to three microliters.

7. The method of claim 6, wherein the Micro-Electro-Mechanical System is a thermal ink jet device.

8. The method of claim 1, wherein applying the adhesive includes dispensing the adhesive from a dispenser including a Micro-Electro-Mechanical System, the adhesive is dispensed as a plurality of individual sub-beads on the edge contacting surface, and a volume of each individual sub-bead is less than or equal to ten nanoliters.

9. The method of claim 8, wherein the Micro-Electro-Mechanical System is a thermal ink jet device.

10. The method of claim 1, wherein the plurality of sheets include an unfolded sheet and the edge contacting surface of the unfolded sheet is on an edge of the unfolded sheet.

11. The method of claim 10, comprising constraining the unfolded sheet to maintain the edge of the unfolded sheet straight.

12. The method of claim 1, wherein the plurality of sheets include a folded sheet and the edge contacting surface of the folded sheet is on a folded edge of the folded sheet.

13. The method of claim 12, comprising constraining the folded sheet to maintain the folded edge straight.

14. The method of claim 1, wherein the edge contacting surface makes line contact with the cover in an area of a spine of the bound document.

15. The method of claim 1, wherein the adhesive is a hot melt adhesive, a light curable adhesive, a two-part adhesive system or a moisture curable adhesive.

16. The method of claim 1, wherein applying the adhesive places a plurality of nanoliter volume beads on the contacting surface at an application rate of no slower than 1 bead per 100 microseconds.

17. The method of claim 1, wherein the plurality of sheets include a sheet of 20 lb bond paper, the adhesive is a light curable adhesive having a viscosity of 10,000 to 12,000 centipoises, applying the adhesive dispenses a plurality of individual sub-beads on the edge contacting surface, a volume of each individual sub-bead is less than or equal to ten nanoliters, and the adhesive cures in less than or equal to 20 seconds to bond the edge contacting surface to the cover.

18. The method of claim 1, comprising forming the cover around the text body.

19. The method of claim 1, wherein the adhesive has a first surface energy, the contacting surface has a second surface energy, and a difference between the first surface energy and the second surface energy is from 13 to 25 dynes per cm.

20. The method of claim 1, wherein the plurality of sheets include a cellulosic sheet having a surface energy of 30 to 37 dynes per cm, the adhesive is a light curable adhesive having a surface energy of 50 to 55 dynes per cm, applying the adhesive dispenses a plurality of individual sub-beads on the edge contacting surface, a volume of each individual sub-bead is less than or equal to ten nanoliters, and the adhesive cures in less than or equal to 20 seconds to bond the contacting surface to the cover, and wherein calculations for surface energy are based on Young's equation, and the surface energy is determined from contact angles of a polar solvent and a nonpolar solvent.

21. The method of claim 1, wherein the applied adhesive is a first part of a two-part adhesive system and the method comprises applying a second part of the two-part adhesive system to the cover prior to adhering the plurality of sheets to the cover on an individual sheet-wise basis.

22. The method of claim 21, wherein the applied first part of the two-part adhesive system forms a non-zero contact angle with the contacting surface.

23. The method of claim 22, wherein a viscosity of the first part of the two-part adhesive system is greater than 1000 centipoises and less than 15,000 centipoises.

24. The method of claim 21, comprising preparing each of the plurality of sheets of the text body along the edge contacting surface prior to applying the first part of the two-part adhesive system.

25. The method of claim 24, wherein preparing increases a surface area of the edge contacting surface, exposes a plurality of base fibers of the sheets, or a combination thereof.

26. The method of claim 21, wherein applying the first part of the two-part adhesive system includes dispensing the first part of the two-part adhesive system from a dispenser, the dispenser including a time-pressure system, a piston-valve system, an auger-valve system, or a jetting system.

27. The method of claim 21, wherein applying the first part of the two-part adhesive system includes dispensing the first part of the two-part adhesive system from a dispenser including a Micro-Electro-Mechanical System, the first part of the two-part adhesive system is dispensed as a continuous bead on the edge contacting surface, and a volume of the continuous bead is less than or equal to three microliters.

28. The method of claim 27, wherein the Micro-Electro-Mechanical System is a thermal ink jet device.

29. The method of claim 21, wherein applying the first part of the two-part adhesive system includes dispensing the first part of the two-part adhesive system from a dispenser including a Micro-Electro-Mechanical System, the first part of the two-part adhesive system is dispensed as a plurality of individual sub-beads on the edge contacting surface, and a volume of each individual sub-bead is less than or equal to ten nanoliters.

30. The method of claim 29, wherein the Micro-Electro-Mechanical System is a thermal ink jet device.

31. The method of claim 21, wherein the plurality of sheets include an unfolded sheet and the contacting surface of the unfolded sheet is on an edge of the unfolded sheet.

32. The method of claim 31, comprising constraining the unfolded sheet to maintain the edge of the unfolded sheet straight.

33. The method of claim 21, wherein the plurality of sheets include a folded sheet and the edge contacting surface of the folded sheet is on a folded edge of the folded sheet.

34. The method of claim 33, comprising constraining the folded sheet to maintain the folded edge straight.

35. The method of claim 21, wherein the edge contacting surface makes line contact with the cover in an area of a spine of the bound document.

36. The method of claim 21, wherein applying the first part of the two-part adhesive system places a plurality of nanoliter volume beads on the edge contacting surface at an application rate of no slower than 1 bead per 100 microseconds.

37. The method of claim 21, wherein the plurality of sheets include a sheet of 20 lb bond paper, the first part of the two-part adhesive system has a viscosity of 10,000 to 12,000 centipoises, applying the first part of the two-part adhesive system dispenses a plurality of individual sub-beads on the edge contacting surface, a volume of each individual sub-bead is less than or equal to ten nanoliters, and the two-part adhesive system cures in less than or equal to 20 seconds to bond the edge contacting surface to the cover.

38. The method of claim 21, comprising forming the cover around the text body.

39. The method of claim 21, wherein the first part of the two-part adhesive system has a first surface energy, the contacting surface has a second surface energy, and a difference between the first surface energy and the second surface energy is from 13 to 25 dynes per cm.

40. The method of claim 21, wherein the plurality of sheets include a cellulosic sheet having a surface energy of 30 to 37 dynes per cm, the first part of the two-part adhesive system is a portion of a light curable adhesive system having a surface energy of 50 to 55 dynes per cm, applying the first part of the two-part adhesive system dispenses a plurality of individual sub-beads on the edge contacting surface, a volume of each individual sub-bead is less than or equal to ten nanoliters, and the light curable adhesive system cures in less than or equal to 20 seconds to bond the contacting surface to the cover, and wherein calculations for surface energy are based on Young's equation, and the surface energy is determined from contact angles of a polar solvent and a nonpolar solvent.

41. The method of claim 1, wherein the edge contacting surface of each of the sheets is provided on an edge of the corresponding sheet, and wherein the side surfaces of each of the sheets extend from the edge along respective sides of the corresponding sheet.

42. A method of binding a text body to a binding structure with an adhesive to form a bound document, the method comprising:

applying an adhesive to an edge contacting surface of each of a plurality of sheets of the text body on an individual sheet-wise basis, wherein the adhesive is applied to the edge contacting surface of each of the plurality of sheets without applying any adhesive to side surfaces of the corresponding sheet; and adhering the plurality of sheets to the binding structure on an individual sheet-wise basis by making line contact between the edge contacting surface of each sheet and the binding structure and by curing the adhesive, wherein the applied adhesive forms a non-zero contact angle with the edge contacting surface.

43. The method of claim 42, wherein the binding structure includes an intermediary piece between the plurality of sheets and a cover.

44. The method of claim 42, comprising preparing each of the plurality of sheets of the text body along the edge contacting surface prior to applying the adhesive.

45. The method of claim 44, wherein preparing increases a surface area of the edge contacting surface, exposes a plurality of base fibers of the sheets, or increases the surface area and exposes the plurality of base fibers.

46. The method of claim 42, wherein the edge contacting surface of each of the sheets is provided on an edge of the corresponding sheet, and wherein the side surfaces of each of the sheets extend from the edge along respective sides of the corresponding sheet.

* * * * *